United States Patent [19]

Yasuda et al.

[11] 4,007,063

[45] Feb. 8, 1977

[54] HEAT TREATING METHOD FOR METAL FILM RESISTOR

[76] Inventors: Toshitaka Yasuda, No. 2211-6, Yamada-Shimo, Suita, Osaka; Hiroshi Takahama, No. 4, 4-Chome, Shuntoku-cho, Higashi-Osaka, Osaka; Hachiro Hamaguchi, No. 269, 3-chome, Gakuen-Daiwa-cho, Nara, Nara; Sajiro Shimizu, No. 81, Sumiyoshi-cho, Sumiyoshi, Osaka, Osaka; Kenji Mori, No. 12-25, 1-chome, Hishiya-Higashi, Higashi-Osaka, Osaka, all of Japan

[22] Filed: June 12, 1975

[21] Appl. No.: 586,284

[30] Foreign Application Priority Data

Aug. 21, 1974 Japan ..... 49-96385

[52] U.S. Cl. ..... 148/6.3; 427/101; 427/103

[51] Int. Cl.[2] ..... H01C 17/06

[58] Field of Search ..... 427/101, 102, 103; 148/6.3

[56] References Cited

UNITED STATES PATENTS

| | | | |
|---|---|---|---|
| 3,172,074 | 3/1965 | Drewes et al. | 427/101 X |
| 3,401,057 | 9/1968 | Eckert et al. | 427/101 |

*Primary Examiner*—Ralph S. Kendall

*Attorney, Agent, or Firm*—Wenderoth, Lind & Ponack

[57] ABSTRACT

A method of heat-treating a metal film for use as a resistor and the resulting product. The method involves heating the film in an oxidizing atmosphere for forming a protective oxide film on the metal film, removing adsorbed foreign elements therefrom, and changing the crystal structure thereof, and for a time sufficient to change the initial temperature coefficient of resistance to a desired value. The temperature for the heating when the coefficient is to be changed in the positive direction is a temperature in the range between the first and second critical temperature for heat treating in and above the third critical temperature. When the coefficient is to be changed in the negative direction, the temperature is between the second and the third critical temperatures for heat treating in air.

24 Claims, 8 Drawing Figures

FIG.1
FIG.1-1
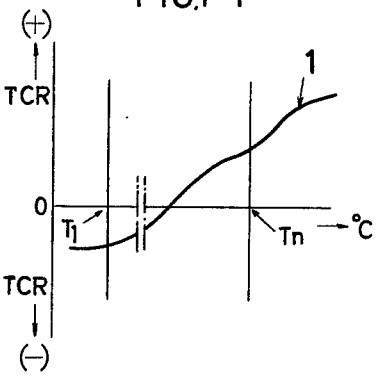
FIG.1-2
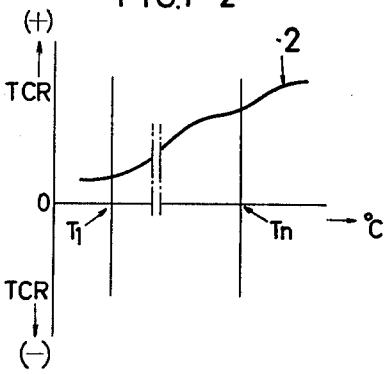
FIG.2
FIG.2-1
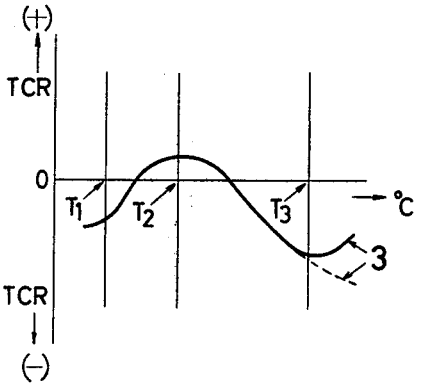
FIG.2-2
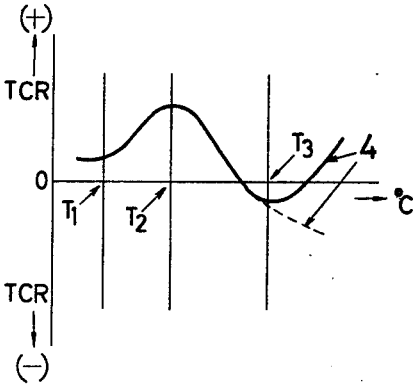

FIG.3
FIG.3-1
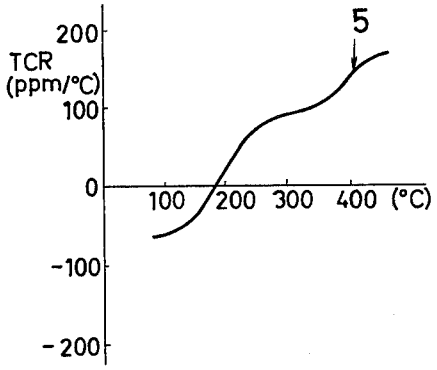
FIG.3-2
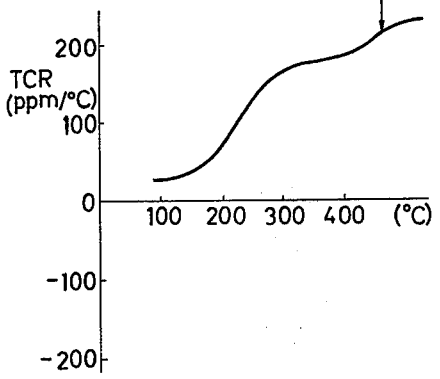
FIG.4
FIG.4-1
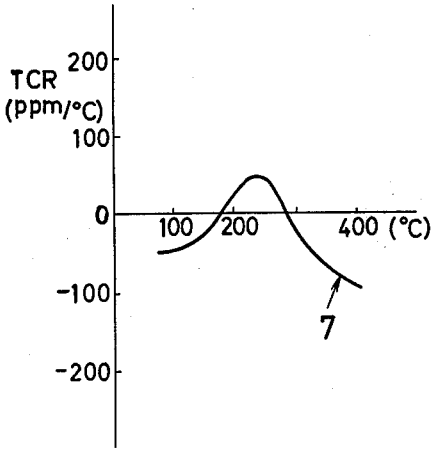
FIG.4-2
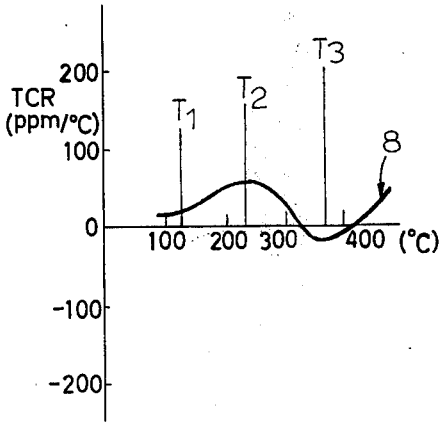

HEAT TREATING METHOD FOR METAL FILM RESISTOR

The present invention relates to a method for heat treating a metal film to form a metal film type resistor, and more particularly, to a heat treatment for forming a protective oxidized film on the metal film surface without damaging the resistor's capacity to handle electric current while simultaneously adjusting the temperature coefficient of resistance (TCR) of the metal film resistor to a value near zero, or to any value either in the positive or in the negative direction therefrom.

Generally, a metal film type resistor is produced by means of plating, vaporizing, sputtering and the like. The metal film type resistor made by the conventional method, however, has a temperature coefficient of resistance (hereinafter abbreviated TCR) which varies over a wide range in accordance with the metallic composition, thickness, plating conditions, adsorbed foreign elements, and the like thereof, the TCR further going through very complex changes during the heat treating process. The present inventors, as a result of their successful study of the foregoing phenomena, have established a method for controlling the TCR of a heat treated metal film so as to enable them to produce a resistor having the most desirable characteristics.

The inventors, in their research on the production of such resistors under various working conditions carried out over a period of several years, have produced a great number of and a great many kinds of metal film resistors. Changes in metallic compositions, thickness, adsorbed foreign elements and the like together with plating, vaporizing, sputtering and the like were carried out during their work, needless to say, and the TCR was measured following the production of the metal film resistors. They have measured changes of TCR resulting from a change of atmosphere and temperature during heat treatment of the metal films to form resistors, i.e. the heat treatment was conducted in air at ordinary pressure under various degrees of vacuum, under various kinds of inert gas. Also examined were the changing state of the crystal structure, adsorbed foreign elements, resistance value and the like of the metal film resistors and their stability with respect to heat and humidity.

The foregoing research has led the inventors to the development of a hypothesis and a confirmation thereof, with the result that they have succeeded in the application of the results of their work to the development of a practical method for the manufacture of metal film type resistors.

The results of their work can be summarized as follows.

Metal film type resistors formed by means of plating, vaporizing, sputtering and the like before being heat treated have no regular metallic structure. They usually have a poor, for resistor purposes, crystalline form in many regards, for example, being amorphous or having a specific crystalline phase, or they contain foreign elements therein. Some of these metal film resistors have no metallic conductivity characteristics, but have a TCR which is negative. The foregoing metal film resistors have TCR's which vary widely, ranging from the negative to the positive, depending on the manufacturing conditions. Generally, the thinner the metal film, the less metallic it is and the more negative its TCR. This trend also applies to the case wherein the metal film has a less desirable crystal structure the more adsorbed foreign elements it contains. For reverse characteristics of thickness, crystal structure and adsorbed foreign elements, the metallic character and TCR of the metal film resistors are also reversed.

When carrying out heat-treatment of these metal film resistors, the crystal structure thereof undergoes changes and adsorbed foreign elements are removed therefrom, thereby bringing the structure of the metal films closer to the state of regular metallic structure. Accordingly, when applying the heat treatment in an atmosphere wherein oxidization is almost impossible, the conductivity of the metal film resistor increases as the treating temperature rises, and simultaneously the TCR thereof is transferred in the positive direction.

On the other hand, when heat treating in an oxidizing atmosphere, two chemical actions occur simultaneously, one being the transference of the TCR in the positive direction due to the same effect as above, and the other being transference of the TCR in the negative direction due to oxidization. (Oxidization in this case denotes a synthetic oxidization of the metal film elements and the adsorbed foreign elements. The metal film being porous, the adsorbed foreign elements are present therein in a dispersed state, and the metal film is caused to become a cermet material due to the oxidization thereof, thereby transferring the TCR in the negative direction.) The heat-treatment thus produces results varying in accordance with the treating temperatures, as follows.

In the realm of lower temperatures (between a first and second critical temperature), the change of crystal structure of the metal film and the separation of adsorbed foreign elements therefrom causes a bigger effect on the TCR than the effect of oxidization, thereby producing a net transfer of the TCR in the positive direction; in the temperature range between the second critical and a third critical temperature, the oxidization becomes more influential than the formerly mentioned factors, thereby producing a net transfer of the TCR in the negative direction; and in the highest temperature range, i.e., temperatures above the third critical temperature (in this case, it is required that the metal film be sufficiently thick to prevent oxidization of inner parts of the film), the oxidization of the surface of the metal film reaches a saturated state, leaving the inside portion thereof unoxidized, thereby making it possible to carry out a change of crystal structure thereof or selective removal of the adsorbed foreign elements therefrom, thereby transferring the TCR in the positive direction.

In heat treating a metal film either in a vacuum or in the air, a reaction develops between the original constituents and adsorbed foreign elements at a comparatively high temperature, the effects on the TCR resulting therefrom being similar to the effect of oxidization on the TCR. The degree of said reaction varies in accordance with the kind and amount of said elements.

The effect of heat treatment can be controlled by adjusting the heat treating time relative to the temperature. That is, the effect of a heat treatment at a fixed temperature for a predetermined number of hours can be equivalent to that produced by treatment at a higher temperature for a lesser number of hours. Also, the same effect can be obtained from a repetition of the heat treatment. On the other hand, the critical temperature for heat treatment varies in accordance with the density of the metal film, even if it has a uniform composition.

The invention will now be described in greater detail in connection with the accompanying drawings, in which:

FIGS. 1—1 and 1–2 are graphs showing the relationship between the heating temperature and the TCR for films heated in a non-oxidizable atmosphere;

FIGS. 2–1 and 2—2 are graphs showing the same relationship as is shown in FIGS. 1—1 and 1–2 for films heated in an oxidizing atmosphere;

FIGS. 3–1 and 3–2 are graphs showing the TCR of Ni-Co alloy films heat treated at various temperatures for 30 minutes in a vacuum; and FIGS. 4–1 and 4–2 are graphs similar to FIGS. 3–1 and 3–2 for films heated in air.

FIGS. 1—1 and 1–2 show the relationship between the temperature of the heat treatment of the metal film in a vacuum (non-oxidizable atmosphere) and the resulting changes in the TCR. In this figure, T1 designates the first critical temperature and Tn designates the nth critical temperature. FIG. 1—1 shows the change in TCR of a metal film resistor which has a very poor or defective crystal structure or which contains a large volume of adsorbed foreign elements and accordingly has conspicuously nonmetallic characteristics (especially where the metal film is thin), and FIG. 1–2 shows the change in TCR of a metal film resistor of the opposite type, i.e. the metal film has a better crystal structure, contains less adsorbed foreign elements, and has metallic conductivity (especially in the case of a thicker metal film). The curves are similar in shape, the latter having a smaller slope and starting at a more positive TCR.

The critical temperature for a heat-treatment in a vacuum may be defined as follows. A metal film produced by plating, vaporizing, sputtering and the like may be amorphous, be defective crystallographically, assume a specific phase, and contain foreign elements, and accordingly be electrically characterized as nonmetallic (particularly as to its TCR), sometimes even having negative values. When this metal film is subjected to a gradual rise in temperature by means of a heat treatment in a vacuum, said foreign elements may separate therefrom, and the amorphous nature changes to crystalline at a certain elevated temperature, so that the crystal transforms with the rise in temperature to a certain degree, and, in accordance with these phenomena, the nonmetallic character of said film changes gradually to metallic. The direction of change of the TCR also undergoes a reversal in accordance with the rise of the temperature. The temperature at which the material undergoes said reversal is called the critical temperature in this specification.

The various critical temperatures in the heat treatment vacuum are as follows.

The first critical temperature, the temperature at which the change of the TCR (in the positive direction) makes the first reversal; and the "*n*"th (including second and third) critical temperature, a temperature wherein the change of the TCR (in the positive direction) undergoes a reversal for the "*n*"th time.

These critical temperatures vary with the constitution of the metal film, the method of manufacturing, and manufacturing conditions, and, accordingly, these critical temperatures, except the first critical temperature, have a relation to some extent to the crystal transforming temperature of a solid metal crystal having the same constitution, although the relationship must be confirmed through case-by-case testing.

FIGS. 2–1 and 2—2 show the relationship between a change of the heat treating temperature and the TCR when heat treating in air (or an equivalent oxidizing atmosphere). In this figure, T1designates the first critical temperature, T2 the second critical temperature, T3 the third critical temperature, and FIGS. 2–1 is for a film type resistor having a poor crystal structure, or which contains a large volume of adsorbed foreign elements, thus having conspicuously nonmetallic characteristics (especially for thinner metal films), and FIG. 2—2 is for a film type resistor having a better crystal structure, containing less adsorbed foreign elements and, accordingly, being metallic (especially for thicker metal films). The curves are similar in shape, the latter having a less steep slope and starting and ending at a more positive TCR.

The dotted portions in FIGS. 2–1 and 2—2 are for the situations wherein the oxidization is not only of the surface of the metal film resistor, but also of the entire thickness of the heat treated metal film, so that there is no third critical temperature therefor (which is more likely to be the case when the metal film is thin).

The critical temperature for a heat treating process in air can be defined as follows. A metal film produced by plating, vaporizing, sputtering and the like may be amorphous and defective crystallographically, assume a specific phase, and contain foreign elements, and, accordingly, said metal film is thus electrically characterized (especially with respect to its TCR) as nonmetallic, sometimes even having negative values. When subjecting this film to a gradual rise in temperature by means of heat treating it in air, said foreign elements separate therefrom, the amorphous state turns crystalline at a certain temperature, the crystal tending to transform when the temperature reaches the level for effectuating said transformation, and simultaneously with these processes, oxidization of the metal film starts at the surface thereof. Among these phenomena, the separation of said foreign elements and the change of the crystal structure thereof causes a gradual increase in the electric metallic character of the metal film, thereby making it possible to change the TCR in the positive direction. (This function is called the positive function.) That is, heat treatment in air produces both positive and negative functions simultaneously, and, accordingly, the TCR tends either in the positive or the negative direction, depending on whether the influence of the positive or negative functions dominate. The critical temperature is the temperature at which the change of TCR undergoes a reversal in accordance with the change of relation between the strength of the positive and negative functions. The various critical temperatures in the heat treatment of the metal film in air are as follows.

The first critical temperature: In heat treatment in air, wherein both the positive and negative functions exist, the positive function is predominant when the temperature is still at a lower level in which the TCR tends to change in the positive direction, and this temperature at which said TCR change begins is called the first critical temperature.

The second critical temperature: After a further rise in the temperature in the foregoing heat treatment, the negative function gradually gains influence, and with a further elevation of the temperature, the TCR eventually changes in the negative direction. The temperature at which this TCR change begins is called the second critical temperature.

The third critical temperature: After a further rise in temperature in the foregoing heat treatment, a metal film of comparatively great thickness may be protected by an oxidized film developed at the surface thereof, thereby preventing said metal film from internal oxidization, resulting in the decline of the influence of the negative function, and, accordingly, the TCR tends to change in the positive direction. The temperature at which this TCR change begins is called the third critical temperature.

The above-described critical temperatures, being specifically prescribed for the heat treatment in this invention, vary in accordance with the composition and methods of producing and conditions of producing the metal films, and therefore the critical temperatures have to be found by means of testing in each case.

When the metal film is so thin as to cause the complete oxidization of said metal film, the third critical temperature may not exist.

The curves shown in FIGS. 1—1, 1–2, 2–1 and 2—2 are typical curves showing changes resulting from heat treatment carried out for a predetermined period of time (about 30 minutes) at various temperatures. Various phenomena due to variation of the metallic composition could be observed in the specimens being treated, especially in the case of FIGS. 2–1 and 2—2, such as change of crystal structure and the fact that when the metal film is very thin, the development of oxidization occurs not only on the surface, but also throughout the entire thickness of said metal film, thereby eliminating the third critical temperature from time to time. The curves of the figures show an inconsistency between temperatures required for the escape of adsorbed foreign elements and for the development of oxidization; uneveness in the changing state of the TCR due to a change of crystal structure and oxidization of the metal film, or variance in the influence of adsorbed foreign elements, thereby causing T1 and T2 or T2 and T3 to be closer to each other, and thereby obscuring distinctions between them as a result.

The curves in FIGS. 1—1 and 1–2 are for a preliminary heat treatment of the metal films. For heat treating already heat treated metal films, the critical temperatures and the shapes of the curves resemble those in FIGS. 2–1 and 2—2, both for the nonoxidizing and the oxidizing atmospheres, although the actual values of the critical temperatures differ.

The above described research has made clear that the metal film which has been heat treated in an oxidizing atmosphere has a stable TCR and, accordingly, is a resistor which is durable even under adverse humidity conditions.

There are two types of oxidizing atmospheres, however. In one, the concentration of oxygen is so low as to make impossible the formation of the protecting oxidized metal film, the amount of oxygen being sufficient only to transfer the TCR in the negative direction. In the other, the concentration of oxygen is sufficient for producing the protecting oxide coating on the metal film, as well as for transferring the TCR in the negative direction.

The information set forth above makes it possible to manufacture easily a metal film resistor, the TCR of which is adjustable to a desired value over a wide range of resistance values, which resistor is stable and durable with respect to heat, humidity and the like.

The heat treatment of this invention has as its purpose to stabilize the crystal structure of the metal film and also the TCR thereof to a desired value, while simultaneously forming a protective oxidized film at the surface thereof, thereby making it possible to protect said metal film from the influence of heat and humidity. The foregoing purpose may be accomplished by utilizing the phenomena according to this invention, as shown in FIGS. 2–1 and 2—2, wherein selection of the heat treating temperatures makes it possible to change the TCR either in the positive direction or in the negative direction, and, accordingly, a TCR of whatever original value may be brought adjacent to zero or changed to whatever value is desired, either in the positive or negative direction. However, if the use of the phenomena of FIGS. 2–1 and 2—2 in the case of heating in air is used too much, there may be inappropriate oxidization of the thickness of the metal film that may, in turn, result in a reduced capacity of said metal film to carry electric current. This defect is greater when the metal film is thinner, and vice-versa, and accordingly, a metal film of comparatively great thickness may be heat treated only in air and when applying the same heat treatment to a metal film of comparatively small thickness, which may result in an excessive inward oxidization and accordingly reduced electric current capacity thereof as above-mentioned, a preliminary heat treatment may be applied to the metal film in a vacuum, thereby changing the crystal structure to cause a growth thereof without oxidization and simultaneously eliminating the adsorbed foreign elements therefrom, thereby lessening the aforementioned crystal defect thereof, and only thereafter carrying out the heat treatment of said metal film in air so that no inward oxidization of said metal film will occur.

The method of carrying out the manufacture is as follows:

1. A heat treatment of a metal film resistor is carried out in an oxidizable atmosphere (in ordinary pressure air or reduced pressure air, for instance air above several mmHg). Where the TCR of the initial film is too low, this heat treatment is carried out at a temperature between the first and the second critical temperature or above the third critical temperature, so that the crystal structure changes and adsorbed foreign elements escape therefrom, thereby causing a bigger effect on the TCR than the effect of the oxidization, resulting in a transfer of the TCR in the positive direction. Heat treatment in this realm makes it possible to bring the TCR close to zero or adjust it to a desired value either negative or positive and simultaneously to stabilize the film type resistor with respect to oxidization at the surface thereof, thereby making the resistance value and TCR almost unchangeable under the influence of heat and humidity.

2. A heat treatment of a metal film resistor is carried out in an oxidizable atmosphere (in ordinary pressure air or reduced pressure air, for instance air above several mmHg). Where the initial TCR of the film is too high, this heat treatment is carried out at a temperature between the second and the third critical temperatures, so that the resulting oxidization acts more effectively on the TCR than the change of crystal structure and the escape of adsorbed foreign elements, thereby making it possible to transfer the TCR in the negative direction. The heat treatment in this realm makes it possible to bring the TCR close to zero or to adjust it to a desired value either negative or positive and simultaneously to stabilize the film type resistor with respect to oxidization at the surface thereof, thereby making the resistance value and TCR almost completely unchangable under the influence of heat and humidity.

The heat treatment methods (1) and (2) are suitable for treating comparatively thick or dense metal film resistors.

It is also preferable to carry out the heat treatment in air at a reduced pressure, so as to prevent excessive oxidization that may cause an unsuitable reduction of electric current capacity of the heat treated metal film resistor.

3. A preliminary heat treating is carried out by placing the metal film in a non-oxidizing or only slightly oxidizing atmosphere and keeping the temperature above the first critical temperature. By the preliminary heat treatment, the crystal structure of the metal film changes and adsorbed foreign elements are removed therefrom, and the TCR is transferred in the positive direction simultaneously with the reduction of the resistance value thereof.

Where the preliminary heat treatment has not increased the TCR sufficiently, the temperature of the main heat treatment should be between the first and the second critical temperatures or above the third critical temperature so that the change of crystal structure of the metal film and the escape of adsorbed foreign elements therefrom causes a bigger effect on the TCR than the oxidization effect, thereby transferring the TCR further in the positive direction.

By carrying out the above-mentioned preliminary and main heat treatments, the TCR of the metal film type resistor can be adjusted so that it is close to zero, or it can be given a desired value, either negative or positive, and simultaneously the film resistor can be stabilized with respect to further oxidation thereof, thereby stabilizing the resistance value and the TCR thereof so as to make the resistor almost free of the influence of heat and humidity.

4. Alternatively, where the preliminary heat treatment has increased the TCR too much, the temperature of the main heat treatment should be between the second and third critical temperature, so that the oxidization works on the TCR more effectively than the change of crystal structure and the escape of adsorbed elements, thereby making it possible to transfer the TCR in the negative direction.

By carrying out the above-described preliminary and main heat treatments, the TCR of the metal film type resistor can be adjusted so that it is close to zero, or to a desired value either negative or positive, and simultaneously the film resistor can be stabilized with respect to oxidization at the surface thereof, thereby making the resistance value and TCR almost free of the influence of heat and humidity.

A single heat treatment only in an oxidizing atmosphere can be used to adjust the TCR and stabilize the metal film resistor with respect to oxidation, of course, but in such a single heat treatment the oxidization tends to be excessive, thereby causing the electric current capacity of said metal film resistor to drop. This problem is especially great in the case of thin metal film which is to have a high resistance. For this reason, when the metal film is thin, the heat treatment needs to be divided into two parts, i.e. the preliminary and main treatments. Also, in order to maintain the electric current capacity of the heat treated metal film as large as possible, it is preferable in the main heat treatment that the temperature be lower than that in the preliminary heat treatment and the pressure be lower than ordinary air pressure.

The foregoing methods (3) and (4) are particularly suited for producing a thin metal film with high resistance.

Several examples will now be given to make possible a better understanding of the invention.

EXAMPLE I

There was first prepared a forsterite rod which was to be made up into a fixed resistor measuring 4.5 mm in diameter and 15 mm long, to which an electroless plating of Ni-Co alloy was applied. This rod was heat treated at various temperatures in a vacuum ($10^{-4}$ – $10^{-5}$ torr) and in ordinary air. The TCR at the various temperatures was as shown in FIGS. 3–1, 3–2, 4–1 and 4–2, respectively. In the above cases, the heat treating continued for 30 minutes at each temperature. When the heat treatment exceeded this time, even by a short time, the results showed little difference compared with the treatment conducted in the vacuum, and further treatment in air caused a decline in the maximum and minimum values of the TCR simultaneously with a downward transference of the temperatures required for bringing the TCR to said maximum and minimum values. FIGS. 3–1 and 4–1 were for a thin metal film less than 0.15 microns thick, and FIGS. 3–2 and 4–2 were for a thick metal film greater than 0.15 microns thick.

The heat treatment of this invention can be applied to Ni-Co alloy film, taking advantage of the relationship between the heat treating temperatures as shown in FIGS. 3 and 4 and the TCR and in particular the critical temperatures. For other kinds of metal, the foregoing test of Example 1 is conducted for confirmation of the relation between the heat treating temperature and TCR so that a metal film resistor having the desired TCR and stability with respect to heat and humidity can be obtained by the application of the heat treatment of this invention.

EXAMPLE II

Forsterite rods for fixed resistors each measuring 4.5 mm in diameter and 15 mm long had applied thereto by electroless plating a film of Ni-Co alloy.

The results of heat treating said rods by the method of this invention is shown in the annexed Table. The preliminary heat treatment was conducted in a vacuum of $10^{-4}$ – $10^{-5}$ torr for about one hour, and the main heat treatment was conducted in air also for about one hour. The heat treatment according to this invention, whatever value the metal film thickness and original TCR thereof may have, makes it possible to obtain a metal film resistor having a desired TCR value and by taking advantage of the phenomena shown in FIGS. 1, 2, 3 and 4. The Table shows that metal films having an original TCR which is about the same can be changed to have TCR's extending over a wide range, ranging from a negative TCR to a positive TCR, including a TCR adjacent zero. Also, a metal film, the original TCR of which is negative, can be as thin as or thinner than 0.15 micron, and one having a positive original can have a thickness no thinner than 0.15 micron.

TABLE 1

| ITEM | 1 | 2 | 3 | 4 | 5 | 6 | 7 | 8 | 9 | 10 | 11 | 12 | 13 |
|---|---|---|---|---|---|---|---|---|---|---|---|---|---|
| TCR (ppm/° C) before heat treatment | −65 | −68 | −60 | 15 | 12 | 11 | 13 | −81 | −75 | −66 | 12 | 15 | 13 |
| Temperature (° C) in the preliminary heat treatment | — | — | — | — | — | — | — | — | — | — | — | — | — |
| TCR (ppm/° C) after the preliminary heat treatment | — | — | — | — | — | — | — | — | — | — | — | — | — |
| Temperature (° C) in the main heat treatment | 170 | 190 | 220 | 200 | 230 | 380 | 400 | 260 | 280 | 300 | 250 | 280 | 300 |
| TCR (ppm/° C) after the main heat treatment | −10 | 2 | 32 | 73 | 79 | 2 | 32 | 20 | 6 | −25 | 63 | 32 | 2 |

| ITEM | | 14 | 15 | 16 | 17 | 19 | 19 | 20 | 21 | 22 | 23 | 24 | 25 |
|---|---|---|---|---|---|---|---|---|---|---|---|---|---|
| TCR (ppm/° C) before heat treatment | | 12 | −75 | −71 | 15 | 11 | −68 | −59 | −70 | 10 | 13 | 12 | 10 |
| Temperature (° C) in the preliminary heat treatment | | — | 230 | 200 | 230 | 200 | 230 | 230 | 230 | 230 | 230 | 230 | 380 |
| TCR (ppm/° C) after the preliminary heat treatment | | — | 60 | 20 | 85 | 63 | 58 | 56 | 60 | 93 | 98 | 102 | 305 |
| Temperature (° C) in the main heat treatment | | 320 | 210 | 220 | 200 | 230 | 260 | 300 | 320 | 250 | 320 | 350 | 370 |
| TCR (ppm/° C) after the main heat treatment | | −8 | 58 | 32 | 87 | 80 | 36 | 3 | −15 | 82 | 3 | −5 | 185 |

What is claimed is:

1. A method for forming a metal film type resistor by heat-treating a metal film having a non-crystalline structure and having adsorbed foreign elements giving nonmetallic resistance characteristics to the film and having a temperature coefficient of resistance which is lower than the desired coefficient for forming the metal film type resistor therefrom, said method comprising:

heating the metal film in an oxidizing atmosphere at a temperature between a first critical temperature and a second critical temperature, said first critical temperature being a temperature at which heating removes said adsorbed foreign elements from the film and changes the film from a non-crystalline state to a crystalline state so that the metal film begins to have a more positive temperature coefficient of resistance, and said second critical temperature being a temperature at which the tendency of the temperature coefficient of resistance to become more negative due to oxidation becomes larger than the tendency for the coefficient to become more positive, said heating being continued until the temperature coefficient of resistance of the film changes the desired amount in the positive direction;

at a temperature above a third critical temperature, which is a temperature at which oxidation of the film reaches a saturation point so that the tendency of the temperature coefficient of resistance to become more negative due to oxidation becomes smaller than the tendency of the coefficient to become more positive due to the temperature rise, said whereby the temperature coefficient of resistance is adjusted to a desired value and a protective oxide film is formed on the film surface and the resistance and the temperature coefficient of resistance are stabilized.

2. A method as claimed in claim 1 in which the oxidization is conducted in air at atmospheric pressure.

3. A method as claimed in claim 1 in which the oxidization is conducted in air at a pressure lower than the atmospheric pressure.

4. A method for forming a metal film type resistor by heat-treating a metal film having a non-crystalline structure and having adsorbed foreign elements giving nonmetallic resistance characteristics to the film and having a temperature coefficient of resistance which is higher than the desired temperature coefficient of resistance for forming the metal film type resistor therefrom, said method comprising:

heating the metal film in an oxidizing atmosphere at a temperature between a second critical temperature and a third critical temperature, said second critical temperature being a temperature at which the tendency of the temperature coefficient of resistance to become more negative due to oxidation becomes larger than the tendency of the coefficient to become more positive, and said third critical temperature being a temperature at which oxidation of the film reaches a saturation point so that the tendency of the temperature coefficient of resistance to become more negative due to oxidation becomes smaller than the tendency of the coefficient to become more positive due to the temperature rise, said heating being continued until the temperature coefficient of resistance of the film changes the desired amount in the negative direction, whereby the temperature coefficient of resistance is brought down to a desired value and a protective oxide film is formed on the film surface and the resistance and the temperature coefficient of resistance are stabilized.

5. A method as claimed in claim 4 in which oxidization is conducted in air at atmospheric pressure.

6. A method as claimed in claim 4 in which oxidization is conducted in air at a pressure lower than atmospheric pressure.

7. A method for forming a metal film type resistor by heat-treating a metal film having a non-crystalline structure and adsorbed foreign elements giving nonmetallic resistance characteristics to the film and having a temperature coefficient of resistance which is lower than the desired coefficient for forming the metal type film resistor therefrom, said method comprising:

preliminarily heating the metal film in an atmosphere which is at most only slightly oxidizing and at a temperature above a first critical temperature, which is a temperature at which heating removes said adsorbed foreign elements from the film and changes the film from a noncrystalline state to a crystalline state so that the metal film begins to have a more positive temperature coefficient of resistance, said preliminary heating being for a time sufficient for partial crystallization but insufficient for bringing the temperature coefficient of resistance to a desired value;

heating the metal film in an oxidizing atmosphere at a temperature between said first critical temperature and a second critical temperature, which is a temperature at which the tendency of the temperature coefficient of resistance to become more negative due to oxidation becomes larger than the tendency of the coefficient to become more positive, said heating being continued until the temperature coefficient of resistance of the film changes the desired amount in the positive direction, whereby the temperature coefficient of resistance is adjusted to a desired value and a protective oxide film is formed on the film surface and the resistance and the temperature coefficient of resistance are stabilized.

8. A method as claimed in claim 7 in which the oxidization is conducted in air at atmospheric pressure.

9. A method as claimed in claim 7 in which the oxidization is conducted in air at a pressure lower than atmospheric pressure.

10. A method as claimed in claim 7 in which the atmosphere is substantially a vacuum.

11. A method as claimed in claim 7 in which the atmosphere is a substantially inert gas.

12. A method for forming a metal film type resistor by heat-treating a metal film having a non-crystalline structure and having adsorbed foreign elements giving nonmetallic resistance characteristics to the film and having an undesired temperature coefficient of resistance for forming the metal film type resistor therefrom, said method comprising:

preliminary heating the metal film in an atmosphere which is at most only slightly oxidizing and at a temperature above a first critical temperature, which is a temperature at which heating removes said adsorbed foreign elements from the film and changes the film from a non-crystalline state to a crystalline state so that the metal film begins to have a more positive temperature coefficient of resistance, said preliminary heating being for a time sufficient to complete crystallization but leaving the temperature coefficient of resistance too high;

heating the metal film in an oxidizing atmosphere at a temperature between a second critical temperature, and a third critical temperature, said second critical temperature being a temperature at which the tendency of the temperature coefficient of resistance to become more negative due to oxidation becomes larger than the tendency of the coefficient to become more positive, and said third critical temperature being a temperature at which oxidation of the film reaches a saturation point so that the tendency of the temperature coefficient of resistance to become more negative due to oxidation becomes smaller than the tendency of the coefficient to become more positive due to the temperature rise, said heating being continued until the temperature coefficient of resistance of the film changes the desired amount in the negative direction, whereby the temperature coefficient of resistance is brought down to a desired value and a protective oxide film is formed on the film surface and the resistance and the temperature coefficient of resistance are stabilized.

13. A method as claimed in claim 12 in which the oxidization is conducted in air at atmospheric pressure.

14. A method as claimed in claim 12 in which the oxidization is conducted in air at a pressure lower than the atmospheric pressure.

15. A method as claimed in claim 12 in which the atmosphere is substantially a vacuum.

16. A method as claimed in claim 12 in which the atmosphere is a substantially inert gas.

17. A method for forming a metal film type resistor by heat-treating a metal film having a non-crystalline structure and having adsorbed foreign elements giving non-metallic resistance characteristics to the film and having a temperature coefficient of resistance which is lower than the desired coefficient for forming the metal film type resistor therefrom, said method comprising:

heating the metal film in an oxidizing atmosphere at a temperature above a third critical temperature, which is a temperature at which oxidation of the film reaches a saturation point so that the tendency of the temperature coefficient of resistance to become more negative due to oxidation becomes smaller than the tendency of the coefficient to become more positive due to the temperature rise, said heating being continued until said coefficient changes the desired amount in the positive direction, whereby the temperature coefficient of resistance is adjusted to a desired value and a protective oxide film is formed on the film surface and the resistance and the temperature coefficient of resistance are stabilized.

18. A method as claimed in claim 17 in which the oxidization is conducted in air at atmospheric pressure.

19. A method as claimed in claim 17 in which the oxidization is conducted in air at a pressure lower than the atmospheric pressure.

20. A method for forming a metal film type resistor by heat-treating a metal film having a non-crystalline structure and adsorbed foreign elements giving non-metallic resistance characteristics to the film and having a temperature coefficient of resistance which is lower than the desired coefficient for forming the metal film type resistor therefrom, said method comprising:

preliminary heating the metal film in an atmosphere which is at most only slightly oxidizing and at a temperature above a first critical temperature, which is a temperature at which heating removes said adsorbed foreign elements from the film and changes the film from a non-crystalline state to a crystalline state so that the metal film begins to have a more positive temperature coefficient of resistance, said preliminary heating being sufficient for partial crystallization but insufficient for bringing the temperature coefficient of resistance to a desired value;

heating the metal film in an oxidizing atmosphere at a temperature above a third critical temperature, which is a temperature at which oxidation of the film reaches a saturation point so that the tendency of the temperature coefficient of resistance to become more negative due to oxidation becomes smaller than the tendency of the coefficient to become more positive due to the temperature rise, said heating being continued until said coefficient changes the desired amount in the positive direction, whereby the temperature coefficient of resistance is adjusted to a desired value and a protective oxide film is formed on the film surface and the resistance and the temperature coefficient of resistance are stabilized.

21. A method as claimed in claim 20 in which the oxidization is conducted in air at atmospheric pressure.

22. A method as claimed in claim 20 in which the oxidization is conducted in air at a pressure lower than atmospheric pressure.

23. A method as claimed in claim 20 in which the atmosphere is substantially a vacuum.

24. A method as claimed in claim 20 in which the atmosphere is substantially an inert gas.

* * * * *